US008808957B2

(12) United States Patent
Hashimoto et al.

(10) Patent No.: US 8,808,957 B2
(45) Date of Patent: Aug. 19, 2014

(54) CARRIER FOR DEVELOPING ELECTROSTATIC IMAGE, DEVELOPER FOR ELECTROSTATIC IMAGE, DEVELOPING DEVICE, CARTRIDGE, PROCESS CARTRIDGE, IMAGE FORMING METHOD, AND IMAGE FORMING APPARATUS

(75) Inventors: Yasuaki Hashimoto, Kanagawa (JP); Yosuke Tsurumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 326 days.

(21) Appl. No.: 13/091,807

(22) Filed: Apr. 21, 2011

(65) Prior Publication Data

US 2012/0122028 A1 May 17, 2012

(30) Foreign Application Priority Data

Nov. 12, 2010 (JP) ..... 2010-253785

(51) Int. Cl.
*G03G 9/00* (2006.01)

(52) U.S. Cl.
USPC ..... 430/111.35; 430/111.1; 430/111.41; 430/108.1

(58) Field of Classification Search
CPC ..... G03G 5/00; G03G 9/00
USPC ..... 430/111.1, 11.35, 111.41, 108.1
See application file for complete search history.

(56) References Cited

U.S. PATENT DOCUMENTS 5,223,366 A * 6/1993 Kubo et al. ..... 430/111.1
5,360,690 A * 11/1994 Nakano et al. ..... 430/108.9

(Continued)

FOREIGN PATENT DOCUMENTS

JP A-8-171236 7/1996
JP A-10-161355 6/1998

(Continued)

OTHER PUBLICATIONS

English translation of JP 2005010183 A, Itami, Japan, Jan. 2005.*

(Continued)

*Primary Examiner* — Mark F Huff
*Assistant Examiner* — Rashid Alam
(74) *Attorney, Agent, or Firm* — Oliff PLC

(57) ABSTRACT

A carrier for developing an electrostatic image, includes: magnetic core material particles and a coated layer coated on the magnetic core material particles, the coated layer containing a resin having a monomer unit represented by formula (A):

(A)

wherein $R^1$ represents a hydrogen atom or a methyl group; $R^2$ to $R^4$ each independently represent a hydrogen atom, an alkyl group, an aryl group or an aralkyl group; $R^5$ independently represents an alkyl group, an aryl group or an aralkyl group; n represents an integer of from 0 to 7; and L1 represents a single bond or an alkylene group, provided that at least one of $R^3$ and $R^4$ is not a hydrogen atom.

9 Claims, 1 Drawing Sheet

(56) References Cited

U.S. PATENT DOCUMENTS

| | | | | |
|---|---|---|---|---|
| 5,932,387 | A | 8/1999 | Yamamoto et al. | |
| 2008/0085460 | A1* | 4/2008 | Ninomiya et al. | 430/109.4 |
| 2009/0109448 | A1* | 4/2009 | Kiyono et al. | 358/1.1 |

FOREIGN PATENT DOCUMENTS

| | | | |
|---|---|---|---|
| JP | A-10-307430 | | 11/1998 |
| JP | 2005010183 | A * | 1/2005 |
| JP | A-2006-243236 | | 9/2006 |
| JP | A-2009-258477 | | 11/2009 |

OTHER PUBLICATIONS

Arthur S. Diamond, Handbook of Imaging Materials, Nov. 28, 2001, Marcel Dekker, Inc., vol. 1, pp. 145-164.*

* cited by examiner

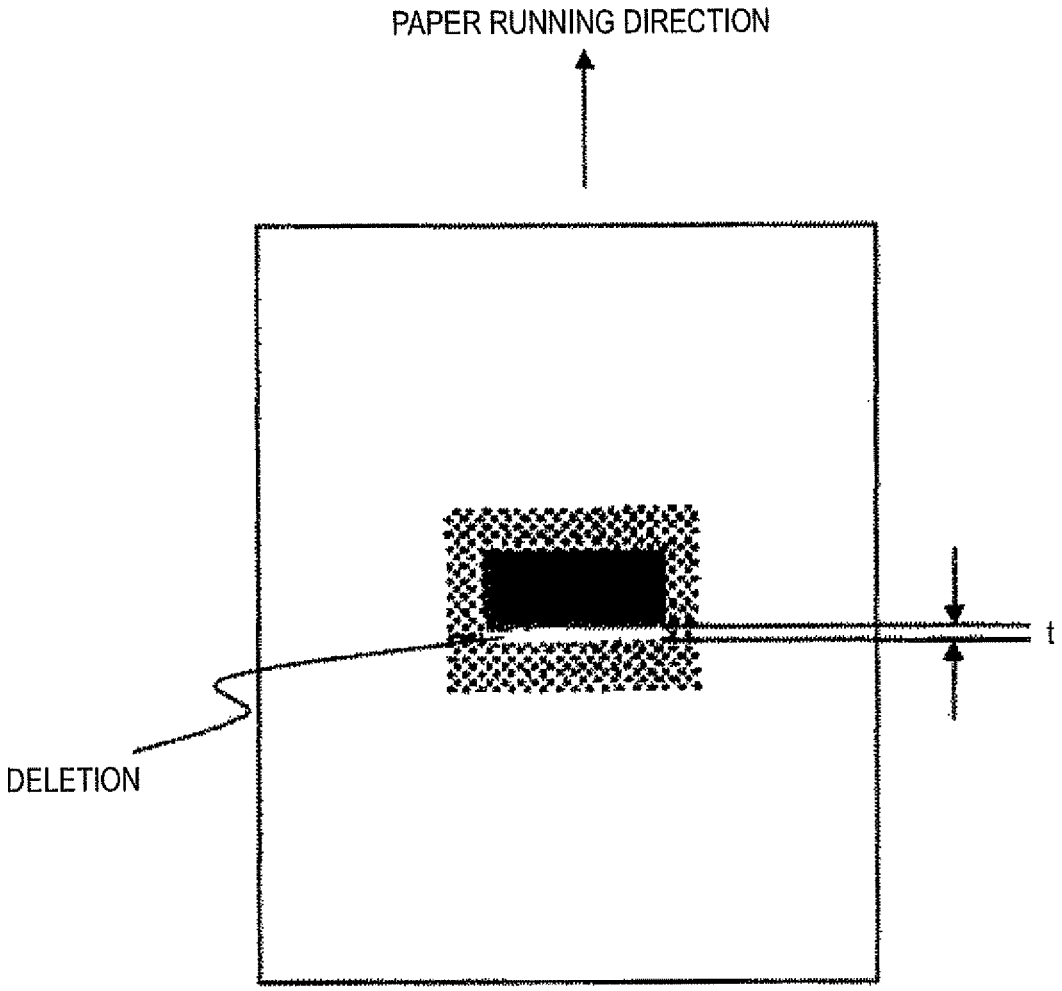
PAPER RUNNING DIRECTION
t
DELETION

CARRIER FOR DEVELOPING ELECTROSTATIC IMAGE, DEVELOPER FOR ELECTROSTATIC IMAGE, DEVELOPING DEVICE, CARTRIDGE, PROCESS CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2010-253785 filed Nov. 12, 2010.

BACKGROUND

1. Technical Field

The present invention relates to a carrier for developing an electrostatic image, a developer for an electrostatic image, a developing device, a cartridge, a process cartridge, an image forming method, and an image forming apparatus.

2. Related Art

A method of visualizing image information through an electrostatic latent image, such as an electrophotographic process, is being utilized in various fields of art. In the electrophotographic process, an electrostatic latent image is formed on a photoconductor through charging and exposing, and the electrostatic latent image is developed with a developer containing a toner and then visualized through transfer and fixing.

The developer used herein includes a two-component developer containing a toner and a carrier, and a single-component developer containing a toner solely, such as magnetic toner. The two-component toner is separated in functions of a developer, i.e., the carrier bears stirring, transportation and charging of the developer, thereby providing good controllability, and thus the two-component developer is being widely used. In particular, a developer containing a carrier having a resin coating is excellent in charge controlling property and thus may be relatively easily enhanced in environmental dependency.

SUMMARY

According to an aspect of the invention, there is provided a carrier for developing an electrostatic image, including:

magnetic core material particles and a coated layer coated on the magnetic core material particles, the coated layer containing a resin having a monomer unit represented by following formula (A):

(A)

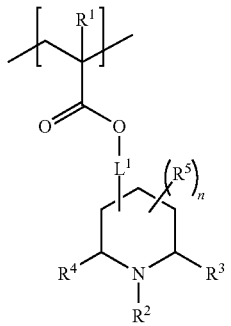

wherein $R^1$ represents a hydrogen atom or a methyl group; $R^2$ to $R^4$ each independently represent a hydrogen atom, an alkyl group, an aryl group or an aralkyl group; $R^5$ independently represents an alkyl group, an aryl group or an aralkyl group; n represents an integer of from 0 to 7; and $L^1$ represents a single bond or an alkylene group, provided that at least one of $R^3$ and $R^4$ is not a hydrogen atom.

BRIEF DESCRIPTION OF THE DRAWINGS

Exemplary embodiments of the present invention will be described in detail based on the following figures, wherein:

FIG. 1 is a schematic illustration showing an example of an image output for evaluating image defect.

DETAILED DESCRIPTION

Exemplary embodiments of the invention will be described in detail below. The invention is not limited to the exemplary embodiments and may be practiced with various modifications unless the substance of the invention is impaired.

Carrier for developing Electrostatic Image

A carrier for developing an electrostatic image (which may be hereinafter referred simply to as a carrier) of the exemplary embodiment contains magnetic core material particles and a coated layer coated on the magnetic core material particles, and the coated layer contains a resin having a monomer unit represented by following formula (A):

(A)

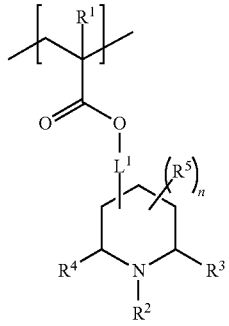

wherein $R^1$ represents a hydrogen atom or a methyl group; $R^2$ to $R^4$ each independently represent a hydrogen atom, an alkyl group, an aryl group or an aralkyl group; $R^5$ independently represents an alkyl group, an aryl group or an aralkyl group; n represents an integer of from 0 to 7; and $L^1$ represents a single bond or an alkylene group, provided that at least one of $R^3$ and $R^4$ is not a hydrogen atom.

The inventors have found that the use of the resin having the monomer unit represented by the formula (A) is effective for enhancing the environmental dependency of the resin coated carrier.

The resin having the monomer unit represented by the formula (A) has such a structure that the nitrogen atoms of the piperidine rings are immobilized regularly aside the main chain, and the hydrocarbon group is present near the nitrogen atom of the piperidine ring, thereby decreasing the influence of water on the nitrogen atom. It is considered that owing to the structure, the developer using the carrier of the exemplary embodiment is stable in charging behavior irrespective of the environment, and the reproducibility of thin lines under a high temperature and high humidity environment, which has been difficult to be achieved, is thus realized.

The constitutional components of the carrier will be described below.

Resin Coated Layer

The carrier of the exemplary embodiment has a coated layer coated on the magnetic core particles, and the coated layer contains a resin having a monomer unit represented by the formula (A), which may be hereinafter referred to as a particular resin. Examples of the resin having the monomer unit represented by the formula (A) include the following for enhancing the reproducibility of thin lines under a high temperature and high humidity.

(A)

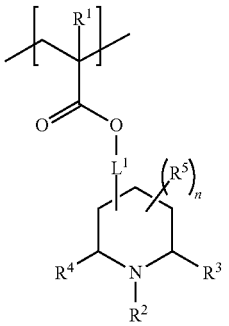

wherein $R^1$ represents a hydrogen atom or a methyl group; $R^2$ to $R^4$ each independently represent a hydrogen atom, an alkyl group, an aryl group or an aralkyl group; $R^5$ independently represents an alkyl group, an aryl group or an aralkyl group; n represents an integer of from 0 to 7; and $L^1$ represents a single bond or an alkylene group, provided that at least one of $R^3$ and $R^4$ is not a hydrogen atom.

In the formula (A), $R^1$ may be a hydrogen atom. Accordingly, the monomer unit represented by the formula (A) may be a monomer unit derived from an acrylate compound.

In the formula (A), $R^2$ may be a hydrogen atom, an alkyl group or an aralkyl group, preferably a hydrogen atom or an alkyl group, more preferably a hydrogen atom or an alkyl group having from 1 to 4 carbon atoms, and further preferably a hydrogen atom or a methyl group.

In the formula (A), $R^3$ and $R^4$ each may independently represent a hydrogen atom or an alkyl group, preferably an alkyl group, more preferably an alkyl group having from 1 to 4 carbon atoms, and further preferably a methyl group, and still further preferably both $R^3$ and $R^4$ each represent a methyl group.

In the formula (A), at least one of $R^3$ and $R^4$ is not a hydrogen atom, and preferably both $R^3$ and $R^4$ are not a hydrogen atom.

In the formula (A), $R^5$, which is a substituent on the piperidine ring, may be an alkyl group having from 1 to 8 carbon atoms, an aryl group having from 6 to 10 carbon atoms or an aralkyl group having from 7 to 18 carbon atoms, preferably an alkyl group having from 1 to 4 carbon atoms or a phenyl group, and more preferably a methyl group.

In the formula (A), n, which is the number of the substituent $R^5$, may be from 0 to 4, preferably 2 or 3, and more preferably 2.

In the formula (A), $L^1$ may be a single bond or an alkylene group having from 1 to 4 carbon atoms, and more preferably a single bond.

In the formula (A), $L^1$ and $R^5$ are each bonded to an arbitrary position on the piperidine ring except for $R^2$ to $R^4$, i.e., the positions shown by X on the piperidine ring shown in the following formula.

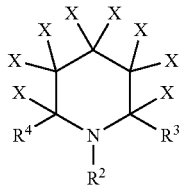

In the formula (A), may be bonded to any one of the 2 to 6-positions of the piperidine ring as described above, and is preferably bonded to the 4-position of the piperidine ring.

In the formula (A), $R^5$ is preferably bonded to at least one of the 2-position and the 6-position of the piperidine ring, and more preferably bonded to both the 2-position and the 6-position of the piperidine ring.

The monomer unit represented by the formula (A) is preferably a monomer unit represented by the following formula (A'), and more preferably a monomer unit represented by the following formula (A").

(A')

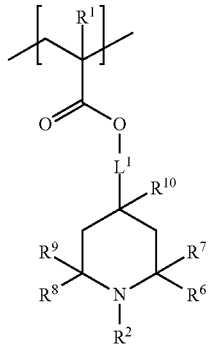

(A")

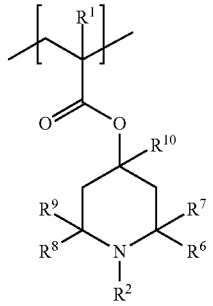

In the formulae (A') and (A"), $R^1$ represents a hydrogen atom or a methyl group; $R^2$ each independently represents a hydrogen atom, an alkyl group, an aryl group or an aralkyl group; $R^6$ represents an alkyl group; $R^7$ to $R^9$ each independently represent a hydrogen atom or an alkyl group; $R^{10}$ represents a hydrogen atom, an alkyl group, an aryl group or an aralkyl group; and $L^1$ represents a single bond or an alkylene group.

$R^1$, $R^2$ and $L^1$ in the formula (A') and $R^1$ and $R^2$ in the formula (A") have the same meanings as $R^1$, $R^2$ and $L^1$ in the formula (A), respectively, and the exemplary ranges and the preferred ranges thereof are also the same.

In the formulae (A') and (A") $R^6$ may be an alkyl group having from 1 to 4 carbon atoms, and preferably a methyl group.

In the formulae (A') and (A"), $R^7$ to $R^9$ each independently may be a hydrogen atom or an alkyl group having from 1 to 4 carbon atoms, preferably a hydrogen atom or a methyl group, and more preferably a methyl group.

In the formulae (A') and (A"), at least two of $R^7$ to $R^9$ each may be an alkyl group, preferably $R^7$ to $R^9$ are all alkyl groups, and more preferably $R^7$ to $R^9$ are all methyl groups.

In the formulae (A') and (A"), $R^{10}$ may be a hydrogen atom, an alkyl group or an aryl group, preferably a hydrogen atom or an aryl group, and more preferably a hydrogen atom.

Specific examples of the monomer unit represented by the formula (A) include monomer units represented by the following formulae (A-1) to (A-3).

(A-1)

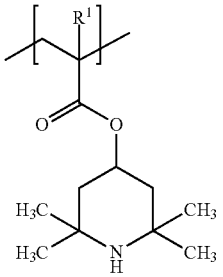

(A-2)

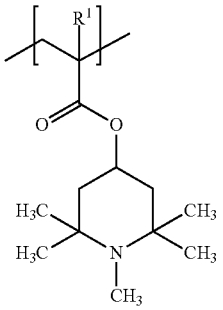

(A-3)

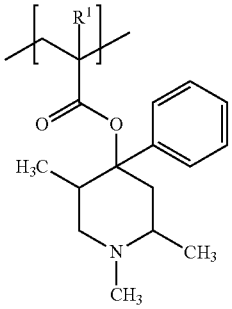

Among these, the monomer units represented by the formulae (A-1) and (A-2) are preferred, and the monomer unit represented by the formula (A-2) is more preferred.

The resin having the monomer unit represented by the formula (A) may be a homopolymer or a copolymer.

The content of the monomer unit represented by the formula (A) may be approximately 10% by mol or more, preferably approximately 20% by mol or more, and more preferably approximately 30% by mol or more, based on the total monomer units of the resin having the monomer unit represented by the formula (A).

The synthesis method of the particular resin is not particularly limited, and for example, the resin may be synthesized by homopolymerization or copolymerization of a monomer represented by the following formula (M), or in alternative, synthesizing a resin having a monomer unit derived from acrylic acid or methacrylic acid, and then introducing the piperidine ring moiety thereto through polymer reaction. In consideration of easiness of synthesis and control of the structure of the resin, the resin may be synthesized by homopolymerization or copolymerization of a monomer represented by the following formula (M).

(M)

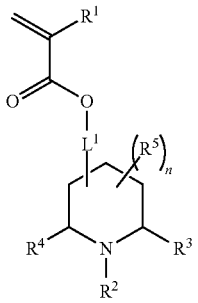

wherein $R^1$ represents a hydrogen atom or a methyl group; $R^2$ to $R^4$ each independently represent a hydrogen atom, an alkyl group, an aryl group or an aralkyl group; $R^5$ independently represents an alkyl group, an aryl group or an aralkyl group; n represents an integer of from 0 to 7; and $L^1$ represents a single bond or an alkylene group, provided that at least one of $R^3$ and $R^4$ is not a hydrogen atom.

$R^1$ to $R^5$, n and $L^1$ in the formula (M) have the same meanings as $R^1$ to $R^5$, n and $L^1$ in the formula (A), respectively, and the exemplary ranges and the preferred ranges thereof are also the same.

Specific examples of the monomer represented by the formula (M) include 2,2,6,6-tetramethyl-4-piperidyl acrylate, 1,2,2,6,6-pentamethyl-4-piperidyl acrylate, 1,2,5-trimethyl-4-phenyl-4-piperidyl acrylate, 2,2,6,6-tetramethyl-4-piperidyl methacrylate, 1,2,2,6,6-pentamethyl-4-piperidyl methacrylate, 1,2,5-trimethyl-4-phenyl-4-piperidyl methacrylate.

Examples of another monomer capable of being used for synthesizing the particular resin than the monomer represented by the formula (M) include an ethylenic unsaturated compound.

Specific examples of the ethylenic unsaturated compound include a styrene compound, such as styrene, p-chlorostyrene and α-methylstyrene; an acrylate compound, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; an unsaturated carboxylic acid, such as acrylic acid and methacrylic acid; an acrylonitrile compound, such as acrylonitrile and methacrylonitrile; a vinyl ether compound, such as vinyl ethyl ether and vinyl isobutyl ether; a ketone compound, such as vinyl methyl ketone, vinyl ethyl ketone and vinyl isopropenyl ketone; and an olefin compound, such as ethylene, propylene, butadiene and isoprene. Among these, a styrene compound and an acrylate compound are preferred.

The monomer may be used solely or as a combination of two or more kinds thereof.

The coated layer may contain carbon black. The carbon black contained may provide excellent suppression of image defect under a low temperature and low humidity environment.

The term "image defect" means such a phenomenon that a deletion due to thinning of the toner occurs at the tail end portion of the image, and it is considered that the image defect occurs in the following mechanism.

When a toner for developing an electrostatic image (which may be hereinafter referred simply to a toner) retained by a carrier is transferred to a photoconductor, the reverse charge with the polarity opposite to the charge of the toner is accumulated in the carrier. The reverse charge accumulated in the carrier attracts a part of the toner, which is thus attached again to the carrier. A deletion occurs consequently. The image defect tends to occur at the edge portion of the image that transits from a low density image to a high density image. In this case, the density at the tail end portion of the low density image is decreased. It is considered that the toner attached to the low density image portion is pulled back to the developer with the electric field in the high density image portion. In general, a resistance under a low temperature and low humidity environment is higher than a resistance under a high temperature and high humidity environment. When the difference in resistance therebetween is large, a carrier that is designed for the resistance under a high temperature and high humidity environment is too high in resistance under a low temperature and low humidity environment, and thus may cause the image defect.

The image defect tends to occur when the resistance of the carrier is higher since the charge therein is hard to erased, and it is therefore considered that the image defect may be suppressed from occurring by adding carbon black to the coated layer to lower the resistance of the carrier. Furthermore, it is considered that the electron distribution becomes homogeneous by the synergistic effect of the unshared electron pair of the nitrogen atom of the piperidine ring in the particular resin and the $\pi$ electrons of the carbon black, and thus the addition of the carbon black suppresses the image defect from occurring.

The carbon black may have a volume average particle size of approximately 0.5 μm or less, preferably from approximately 0.01 μm to approximately 0.5 μm, and more preferably from approximately 0.03 μm to approximately 0.35 μm. When the volume average particle size is in the range, the carbon black is hard to be dropped off from the coated layer, thereby providing stable charging property.

The volume average particle size of the carbon black may be measured with a laser diffraction particle size distribution measuring device (LA-700, available from Horiba, Ltd.).

The volume average particle size of the carbon black may be measured in such a manner that 2 g of a sample to be measured is put in 50 mL of a surfactant aqueous solution, which may be a 5% aqueous solution of sodium alkylbenzenesulfonate, and dispersed with an ultrasonic dispersing device (1,000 Hz) for 2 minutes to prepare a measurement sample, which is then measured.

The volume average particle sizes of each of the channels are accumulated from the small volume average particle size side, and the value at an accumulation of 50% is designated as the volume average particle size.

Examples of the carbon black include furnace black, ketchen black and channel black.

Specific examples thereof include #3350B, #30 and #3030B, available from Mitsubishi Chemical Corporation, #5500, available from Tokai Carbon Co., Ltd., granular acetylene black, available from Denki Kagaku Kogyo Kabushiki Kaisha, HS-500, Asahi Thermal FT and Asahi Thermal MT, available from Asahi Carbon Co., Ltd., ketchen black, available from Lion Akzo Co., Ltd., Vulcan XC-72, Regal 400R and Monarch 1300, available from Cabot Specialty Chemicals, Inc., and Color Black FW200, Special Black 4, Printex 150T, Printex 140T and Printex U, available from Degussa AG.

The content of the carbon black in the coated layer may be 15.0% by weight or less, or approximately 15.0% by weight or less, preferably from approximately 3.0 to 12.0% by weight, and more preferably from approximately 4.0 to 10.0% by weight, based on the total weight of the particular resin in the coated layer.

The resistance of the carrier may be necessarily high for providing reproducibility of thin lines under a high temperature and high humidity environment. When the resistance of the carrier is low, the toner has low charging property, and the toner excessively developed on thin lines. When the content of the carbon black is in the range, excellent reproducibility of thin lines under a high temperature and high humidity environment may be obtained.

The carrier of the exemplary embodiment may contain a charge controlling agent. The charge controlling agent may be used in combination with the carbon black.

The charge controlling agent may be any known charge controlling agent, such as a nigrosine dye, a benzimidazole compound, a quaternary ammonium salt compound, an alkoxylated amine, an alkylamide, a molybdic acid chelate pigment, a triphenylmethane compound, a salicylic acid chelate compound, an azo-chromium complex and copper phthalocyanine. Preferred examples among these include a quaternary ammonium salt compound, an alkoxylated amine and an alkylamide.

The amount of the charge controlling agent added may be from approximately 0.001 part by weight to approximately 5 parts by weight, and preferably from approximately 0.01 part by weight to approximately 0.5 part by weight, per 100 parts by weight of the particular resin in the coated layer. When the amount of the charge controlling agent is in the range, the coated layer has a sufficient strength, which provides a carrier that is hard to be degraded due to stress upon use, and also provides good dispersibility of the electroconductive material.

The coated layer may also contain wax.

Wax is hydrophobic, and is relatively soft with low film strength at ordinary temperature. These are derived from the molecular structure of wax, and when the coated layer contains wax, such toner components as fine particles referred to as an external additive added to the surface of the toner and toner bulk component are prevented from being attached to the surface of the carrier owing to the properties of wax. Furthermore, even when the toner components are attached to the surface of the carrier, the surface is renewed by flaking of the wax molecules from the attached part, thereby preventing the surface of the carrier from being contaminated.

The wax is not particularly limited, and examples thereof include paraffin wax and a derivative thereof, montan wax and a derivative thereof, microcrystalline wax and a derivative thereof, Fischer-Tropsch wax and a derivative thereof, and polyolefin wax and a derivative wax. The derivative referred herein includes a polymer with a vinyl monomer and a graft-modified product. Examples of the wax also include an alcohol, a fatty acid, vegetable wax, animal wax, mineral wax, ester wax and an acid amide. Any other known wax may be used.

The wax may have a melting point of from approximately 60° C. to approximately 200° C., and preferably from approximately 80° C. to approximately 150° C. When the melting point of the wax is approximately 60° C. or more, the carrier may have excellent flowability.

The coated layer may contain another resin in addition to the particular resin.

Examples of the another resin used in the coated layer include polyethylene, polypropylene, polystyrene, polyacrylonitrile, polyvinyl acetate, polyvinyl alcohol, polyvinyl butyral, polyvinyl chloride, polyvinylcarbazole, polyvinyl ether, polyvinyl ketone, a vinyl chloride-vinyl acetate copolymer, a styrene-acrylic acid copolymer, a linear silicone resin containing an organosiloxane bond and a modified product thereof, a fluorine resin, polyester, polyurethane, polycarbonate, a phenol resin, an amino resin, a melamine resin, a benzoguanamine resin, a urea resin, an amide resin and an epoxy resin, but the another resin is not limited to the examples.

The coated layer may contain electroconductive powder other than carbon black.

Examples of the electroconductive powder include metal particles, such as gold, silver and copper; a semielectroconductive oxide particles, such as titanium oxide and zinc oxide; and particles containing powder, such as titanium oxide, zinc oxide, barium oxide, aluminum borate and potassium titanate, coated with tin oxide, a metal or the like.

The electroconductive powder may be used solely or as a combination of two or more kinds thereof.

The electroconductive powder may have a volume electric resistance of from approximately $10^1$ Ω·cm to approximately $10^{11}$ Ω·cm, and preferably from approximately $10^3$ Ω·cm to approximately $10^9$ Ω·cm.

The volume electric resistance of the electroconductive powder may be measured in the same manner as the volume electric resistance of the core material particles described later.

The electroconductive powder may have a volume average particle size of approximately 0.5 μm or less, preferably from approximately 0.05 μm to approximately 0.5 μm, and more preferably from approximately 0.05 μm to approximately 0.35 μm.

The content of the electroconductive powder is not particularly limited, and when the coated layer contains the carbon black, the content of the electroconductive powder may be smaller than the content of the carbon black.

The coated layer may contain resin particles.

Examples of the resin particles include thermoplastic resin particles and thermosetting resin particles. Among these, thermosetting resin particles are preferred since the hardness thereof may be increased relatively easily. The resin particles may be used solely or as a combination of two or more kinds thereof.

The resin particles may have a volume average particle size of from approximately 0.1 μm to approximately 2.0 μm, and preferably from approximately 0.2 μm to approximately 1.0 μm.

The content of the resin particles is not particularly limited, and when the coated layer contains the carbon black, the content of the resin particles may be smaller than the content of the carbon black.

The coated layer may contain known additives depending on necessity.

The method for forming the coated layer on the surface of the core material particles is not particularly limited, and examples of the method include a method of using a coating composition for forming a coated layer containing the particular resin and optional components, such as the carbon black and the charge controlling agent, in a solvent.

Examples of the method include a dipping method of dipping the core material particles in the coating composition for forming the coated layer, a spraying method of spraying the coating composition on the surface of the core material particles, and a kneader-coater method of mixing the core material particles and the coating composition, and then removing the solvent, in the state where the core material particles are floated with air flow. Among these, a kneader-coater method may be preferred in the exemplary embodiment.

The solvent used in the coating composition for forming a coated layer is not particularly limited and may be any one that dissolves only the resin, and the solvent may be selected from known solvents. Specific examples thereof include an aromatic hydrocarbon compound, such as toluene and xylene, a ketone compound, such as acetone and methyl ethyl ketone, and an ether compound, such as tetrahydrofuran and dioxane.

The coated layer is not limited to a single layer and may have a structure containing two or more layers.

The total content of the coated layer in the carrier of the exemplary embodiment may be from approximately 0.5 part by weight to approximately 10 parts by weight, preferably from approximately 1 part by weight to approximately 5 parts by weight, and more preferably from approximately 1 part by weight to approximately 3 parts by weight, per 100 parts by weight of the core material particles. When the content of the coated layer is approximately 0.5 part by weight or more, the surface of the core material powder is less exposed, and injection of the developing electric field is prevented. When the content of the coated layer is approximately 10 parts by weight or less, the coated layer forms a less amount of resin powder released therefrom, and the formation of resin powder due to release off during development may be prevented from the initial stage.

The coverage of the coated layer on the surface of the core material particles in the carrier of the exemplary embodiment may be approximately 80% or more, and preferably approximately 85% or more, and may be preferably as close as possible to 100%, while depending on the surface shape of the core material particles. When the coverage is approximately 80% or more, a deletion on an image may be suppressed from occurring.

Examples of a method for measuring the coverage of the coated layer in the carrier of the exemplary embodiment include a method of observing with an optical microscope, and a method of measuring by XPS measurement shown below.

In the XPS measurement, for example, an XPS measurement device may be JPS 80, available from JEOL, Ltd., and the measurement may be performed for the major element constituting the coated layer (which is generally carbon) and the major element constituting the core material particles (which is generally iron and oxygen when the core material particles are constituted by an iron oxide series material, such as magnetite) with MgKα line as the X-ray source at an acceleration voltage of 10 kV and an emission current of 20 mV. (In the following description, the case where the core material particles are constituted by an iron oxide series material will be described.) The C 1s spectrum is measured for carbon, the Fe $2p_{3/2}$ spectrum is measured for iron, and O 1s spectrum is measured for oxygen.

The number of atoms of carbon, oxygen and iron ($A_c+A_o+A_{Fe}$) is obtained from the spectra of these elements. The iron amount of the core material particles and the iron amount of the carrier containing the core material particles coated with the coated layer are obtained according to the following expression (9), and the coverage is obtained according to the expression (10).

$$\text{iron amount(atomic \%)}-(A_{Fe}/(A_c+A_o+A_{Fe}))\times 100 \quad (9)$$

$$\text{coverage(\%)}=(1-(\text{iron amount of carrier})/(\text{iron amount of core material particles}))\times 100 \quad (10)$$

In the case where a material other than the iron oxide series material is used as the core material particles, the coverage may be obtained in such a manner that the spectrum of a metal element constituting the core material particles is measured in addition to oxygen, and the similar calculation may be performed according to the expressions (9) and (10).

The coated layer may have an average thickness of from approximately 0.1 μm to approximately 10 μm, preferably from approximately 0.1 μm to approximately 3.0 μm, and more preferably from approximately 0.1 μm to approximately 1.0 μm.

The average thickness (μm) of the coated layer may be obtained according to the following expression (11) from the true specific gravity ρ (dimensionless) of the core material particles, the volume average particle size d (μm) of the core material particles, the average specific gravity $\rho_c$ of the coated layer, and the total content $W_c$ (part by weight) of the coated layer per 100 parts by weight of the core material particles.

$$\begin{aligned}\text{average thickness } (\mu m) &= ((\text{coated amount per one carrier particle (including additives, such as electroconductive powder)}/\\ &\quad \text{(surface area of one carrier particle))}/\\ &\quad \text{(average specific gravity of coated layer)} =\\ &\quad (((4/3)\cdot\pi\cdot(d/2)^3\cdot\rho\cdot W_c)/(4\pi\cdot(d/2)^2))/\rho_c =\\ &\quad (1/6)\cdot(d\cdot\rho\cdot W_c/\rho_c)\end{aligned} \quad (11)$$

Magnetic Core Material Particles

Examples of the magnetic core material particles (which may be hereinafter referred simply to as a core material) used in the carrier of the exemplary embodiment include resin particles having a magnetic metal, a magnetic oxide or magnetic particles dispersed therein.

The material of the magnetic particles (core material) used in the carrier of the exemplary embodiment is not particularly limited as far as the material satisfies the following conditions.

Specific examples thereof include a magnetic metal, such as iron, steel, nickel and cobalt, an alloy of the magnetic metal and another metal, such as manganese, chromium and a rare earth element, and a magnetic oxide, such as ferrite and magnetite.

Preferred examples of the core material include ferrite particles since a uniform surface and stable charging property may be obtained.

Examples of the ferrite for the core material include the following ferrite materials.

$$(MO)_X(Fe_2O_3)_Y$$

wherein M represents at least one selected from Cu, Zn, Fe, Mg, Mn, Ca, Li, Ti, Ni, Sn, Sr, Al, Ba, Co, Mo and the like, and X and Y each represent the proportion in terms of molar ratio, provided that X+Y=100.

Such a ferrite material may be preferred that M is one of or a combination of plural kinds of Li, Mg, Ca, Mn, Sr and Sn, and the content of the other component than M is approximately 1% by weight or less. When the aforementioned metal elements are contained, the core material may have a suitable electric resistance, the coverage may be easily controlled to an intended range, and excellent environmental dependency may be obtained.

Among these, M is preferably one of or a combination of plural kinds of Li, Mn, Mg and Sr. When Li is contained, the resistance is hard to be broken down upon application of a strong electric field. When Mn is contained, a high saturated magnetization may be obtained. When Mg is contained, the specific gravity may be decreased. When Sr is contained, the saturated magnetization may be increased. Thus, these elements are preferred as the magnetic core material.

The core material may be formed through granulation and baking, and as a pre-treatment, the core material may be finely pulverized. The pulverizing method is not particularly limited, and known pulverizing methods may be employed. Examples of the pulverizing method include methods using a mortar, a ball mill and a jet mill. The final pulverized state after the pre-treatment varies depending on the material and the like, and the volume average particle size of the core material before granulation and baking may be from approximately 2 μm to approximately 10 μm. When the volume average particle size is in the range, the material may have a particle size that is suitable for use, and an intended particle size may be easily obtained with an appropriate circularity.

The core material used in the exemplary embodiment may be resin particles having magnetic particles dispersed therein (which may be hereinafter referred to as magnetic material dispersed resin particles).

Examples of the magnetic material dispersed in the core material include a magnetic metal, such as iron, steel, nickel and cobalt; an alloy of the magnetic metal and another metal, such as manganese, chromium and a rare earth element (e.g., nickel-iron alloy, aluminum-iron alloy); and a magnetic oxide, such as ferrite and magnetite. Among these, iron oxide is preferred. Iron oxide particles as the magnetic material particles are stable and less toxic.

The magnetic material may be used solely or as a combination of two or more kinds thereof.

The magnetic material may have a volume average particle size of from approximately 0.01 μm to approximately 1 μm, preferably from approximately 0.03 μm to approximately 0.5 μm, and more preferably from approximately 0.05 μm to approximately 0.35 μm. When the volume average particle size of the magnetic material is in the range, sufficient saturation magnetization or suitable viscosity of the composition (monomer mixture) is obtained to provide a carrier with a uniform particle size and uniform magnetic material dispersed resin particles.

The content of the magnetic material in the magnetic material dispersed resin particles may be from approximately 30% by weight to approximately 99% by weight, preferably from approximately 45% by weight to approximately 97% by weight, and more preferably from approximately 60% by weight to approximately 95% by weight. When the content of the magnetic material is in the range, the carrier containing the magnetic material dispersed resin particles as a core material (i.e., a magnetic material dispersed carrier) is less scattered, and a magnetic brush of the magnetic material dispersed carrier does not become too hard to prevent the brush from being broken.

Examples of the resin component in the magnetic material dispersed resin particles include a cross linked styrene resin, an acrylic resin, a styrene-acrylic copolymer resin and a phenol resin.

The magnetic material dispersed resin particles used in the exemplary embodiment may further contain, in addition to the resin component and the magnetic material powder, other components depending on purposes. Examples of the other components include a charge controlling agent and fluorine-containing particles.

Examples of the preparation method of the magnetic material dispersed resin particles include a melt-kneading method, in which the magnetic material powder and the binder resin, such as a styrene-acrylic resin, are melt-kneaded with a Banbury mixer, a kneader or the like, and then cooled, followed by pulverization and classification (as described, for example, in JP-B-59-24416 and JP-B-8-3679), a suspension polymerization method, in which a monomer of the binder resin and the magnetic material powder are dispersed in a solvent to prepare a suspension liquid, and the suspension liquid is subjected to polymerization (as described, for example, in JP-A-5-100493), and a spray drying method, in which the magnetic material powder is mixed and dispersed in a solution of the resin, and the solution is spray-dried.

The core material may have a volume average particle size of from approximately 10 μm to approximately 500 μm, preferably from approximately 20 μm to approximately 150 μm, and more preferably from approximately 30 μm to approximately 100 μm. When the volume average particle size of the core material is approximately 10 μm or more, the adhesion force between the toner and the carrier upon using for developing an electrostatic image may be appropriate to provide a sufficient developed amount of the toner. When the volume average particle size thereof is approximately 500 μm or less, the magnetic brush may not be coarse to provide a fine image.

The volume average particle size of the core material may be measured, for example, with Coulter Counter TA-II (available from Beckman Coulter, Inc.), Coulter Multisizer II (available from Beckman Coulter, Inc.), a laser diffraction/scattering particle size analyzer (LS Particle Size Analyzer LS13, 320, available from Beckman Coulter, Inc.) and the like. The volume average particle sizes of each of the channels are accumulated from the small volume average particle size side, and the value at an accumulation of 50% is designated as the volume average particle size.

The carrier may have a weight average particle size of from approximately 15 μm to approximately 500 μm, and preferably from approximately 25 μm to approximately 150 μm. When the volume average particle size of the carrier is approximately 15 μm or more, the carrier may be less contaminated. When the volume average particle size of the carrier is approximately 500 μm or less, deterioration of the toner on stirring may be prevented.

The volume average particle size of the carrier may be measured, for example, with Coulter Counter TA-II (available from Beckman Coulter, Inc.), Coulter Multisizer II (available from Beckman Coulter, Inc.), a laser diffraction/scattering particle size analyzer (LS Particle Size Analyzer LS13, 320, available from Beckman Coulter, Inc.) and the like.

The carrier may have a shape factor SF1 of from approximately 100 to approximately 145 for achieving both high image quality and stirring efficiency of the developer.

The shape factor SF1 of the carrier means a value obtained by the following expression (12).

$$SF1=100\pi\times(ML)^2/(4\times A) \quad (12)$$

wherein ML represents the maximum length of the carrier particles, and A represents the projected area of the carrier particles.

The maximum length and the projected area of the carrier particles may be measured in such a manner that the carrier particles sampled on slide glass are observed with an optical microscope, and the image is input for image analysis to an image analyzer (Luzex III, available from Nireco Corporation) through a video camera. The number of the sampled carrier particles is 100 or more, and the shape factor SF1 is calculated by using the average value of the sampled carrier particles according to the expression (12).

Developer for Electrostatic Image

The developer for an electrostatic image (which may be hereinafter referred to as a developer) of the exemplary embodiment is a two-component developer, which may contain a carrier for developing an electrostatic image according to the exemplary embodiment and a toner for developing an electrostatic image.

The mixing ration (weight ratio) of the carrier for developing an electrostatic image of the exemplary embodiment and a toner for developing an electrostatic image in the developer for an electrostatic image of the exemplary embodiment (toner/carrier) may be from approximately 1/99 to approximately 20/80, and preferably from approximately 3/97 to approximately 12/88.

The mixing method of the carrier and the toner is not particularly limited, and they may be mixed with known apparatus and method, such as a V-blender.

Toner for Developing Electrostatic Image

The toner for developing an electrostatic image (which may be hereinafter referred to as a toner) used in the exemplary embodiment is not particularly defined and is not particularly limited as a toner, and a known toner may be used. Examples of the toner include a color toner containing a binder resin and a colorant. Examples of the toner also include an infrared ray absorbing toner containing a binder resin and an infrared ray absorbent.

Toner Mother Particles

Toner mother particles of the toner used in the exemplary embodiment may contain a binder resin and a colorant, and may further contain depending on necessity a releasing agent, silica and a charge controlling agent.

Examples of the binder resin include homopolymers and copolymers of a styrene compound, such as styrene and chlorostyrene; a monoolefin compound, such as ethylene, propylene, butylene and isoprene; a vinyl ester compound, such as vinyl acetate, vinyl propionate, vinyl benzoate and vinyl lactate; an α-methylene aliphatic monocarboxylate ester compound, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; a vinyl ether compound, such as vinyl methyl ether, vinyl ethyl ether and vinyl butyl ether; a vinyl ketone compound, such as vinyl methyl ketone, vinyl hexyl ketone and vinyl isopropenyl ketone; and the like.

Representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Examples of the binder resin further include polyester, polyurethane, an epoxy resin, a silicone resin, polyamide, modified rosin and paraffin wax. Among these, a styrene-alkyl acrylate copolymer, a styrene-alkyl methacrylate copolymer and a polyester resin are preferred.

The binder resin used in the toner is not limited to an amorphous resin, but a crystalline resin may be used depending on necessity. The crystalline resin is not particularly limited as far as it has crystallinity, and examples thereof include a crystalline polyester resin and a crystalline vinyl resin. From the standpoint of reproducibility of thin lines under a high temperature and high humidity environment, a crystalline polyester resin is preferred, and a crystalline aliphatic polyester resin having a suitable melting point is more preferred.

Examples of the colorant of the toner include magnetic powder, such as magnetite and ferrite, pigments, such as carbon black, lamp black, Chrome Yellow, Hansa Yellow, Benzidine Yellow, Indanthrene Yellow, Quinoline Yellow, Permanent Orange GTR, Pyrazolone Orange, Vulkan Orange, Watchyoung Red, Permanent Red, Brilliant Carmine 3B, Brilliant Carmine 6B, Du Pont Oil Red, Pyrazolone Red, Lithol, Rhodamine B Lake, Lake Red C, Rose Bengal, Aniline Blue, Ultramarine Blue, Calco Oil Blue, Methylene Blue Chloride, Phthalocyanine Blue, Phthalocyanine Green and Malachite Green Oxalate, and dyes, such as an acridine series, a xanthene series, an azo series, a benzoquinone series, an azine series, an anthraquinone series, a thioindigo series, a dioxadine series, a thiazine series, an azomethine series, an indigo series, a phthalocyanine series, an aniline black series, a polymethine series, a triphenylmethane series, a diphenylmethane series, a thiazine series, and a thiazole series, which may be used solely or as a combination of two or more kinds thereof.

Examples of the colorant also include C.I. Pigment Red 48:1, C.I. Pigment Red 122, C.I. Pigment Red 57:1, C.I. Pigment Yellow 97, C.I. Pigment Yellow 17, C.I. Pigment Blue 15:1 and C.I. Pigment Blue 15:3.

The content of the colorant in the toner may be from approximately 1 part by weight to approximately 30 parts by weight per 100 parts by weight of the binder resin of the toner. A colorant having been surface-treated and a pigment dispersant may also be used depending on necessity. A yellow toner, a magenta toner, a cyan toner, a black toner and the like may be prepared by appropriately selecting the colorants.

The toner may contain a releasing agent and a charge controlling agent depending on necessity.

Examples of the releasing agent include a low molecular weight polyolefin, such as polyethylene, polypropylene and polybutene; a silicone compound having a softening point on heating; a fatty acid amide compound, such as oleic acid amide, erucic acid amide, recinoleic acid amide and stearic acid amide; vegetable wax, such as ester wax, carnauba wax, rice wax, candelilla wax, wood wax and jojoba oil; animal wax, such as beeswax; mineral wax, such as montan wax, ozokerite, ceresin, paraffin wax, microcrystalline wax and Fischer-Tropsch wax; petroleum wax; modified products thereof.

The amount of the releasing agent added may be approximately 50% by weight or less based on the total weight of the toner.

The charge controlling agent may be a known one and examples thereof include an azo metal complex compound, a metal complex compound of salicylic acid, and a charge controlling agent containing a resin having a polar group.

Examples of the preparation method of the toner mother particles include: a kneading and pulverizing method, in which a binder resin and a colorant, and depending on necessity a releasing agent, a charge controlling agent and the like are kneaded, pulverized and classified; a method, in which particles obtained by the kneading and pulverizing method are changed in shape thereof with mechanical impact or heat energy; an emulsification and aggregation method, in which a dispersion containing a binder resin emulsified dispersed therein and dispersions of a colorant and depending on necessity a dispersion of a releasing agent, a charge controlling agent and the like are mixed, and the particles are aggregated and integrated by heating, thereby providing toner particles; an emulsion polymerization and aggregation method, in which a polymerizable monomer of a binder resin is emulsion-polymerized, and the dispersion and dispersions of a colorant and depending on necessity a releasing agent, a charge controlling agent and the like are mixed, and the particles are aggregated and integrated by heating, thereby providing toner particles; a suspension polymerization method, in which a polymerizable monomer of a binder resin and solutions of a colorant and depending on necessity a releasing agent, a charge controlling agent and the like are suspended in an aqueous solvent and then polymerized; and a dissolution and suspension method, in which a solution of a binder resin and a colorant, and depending on necessity a releasing agent, a charge controlling agent and the like is suspended in an aqueous solvent and granulated. Such a preparation method may also be employed that the toner mother particles obtained by the aforementioned methods are used as core particles, on which aggregated particles are attached and integrated by heating, thereby providing a core-shell structure.

Among these, the toner of the exemplary embodiment may be a toner prepared by the emulsification and aggregation method or the emulsion polymerization and aggregation method, i.e., an emulsion aggregation toner.

The toner mother particles thus prepared may have a volume average particle size of from approximately 2 μm to approximately 8 μm, and preferably from approximately 3 μm to approximately 7 μm.

The toner mother particles may have a pseudo-spherical shape from the standpoint of enhancement of the developing property, the transferring efficiency and the image quality. The sphericity of the toner mother particles may be expressed by the shape factor SF1 shown by the following expression (1), and the average value of the shape factor SF1 (average shape factor) of the toner mother particles used in the exemplary embodiment may be less than approximately 145, preferably approximately 115 or more and less than approximately 140, and more preferably approximately 120 or more and less than approximately 140. When the average value of the shape factor SF1 is less than approximately 145, good transferring efficiency may be obtained to provide high image quality.

$$SF1 = \frac{(ML)^2}{A} \times \frac{\pi}{4} \times 100 \quad (1)$$

In the expression (1), ML represents the maximum length of the toner mother particles, and A represents the projected area of the toner mother particles.

The average value of the shape factor SF1 (average shape factor) may be measured in such a manner that an optical micrograph of 1,000 toner particles magnified 250 times is analyzed with an image analyzer (Luzex III, available from Nireco Corporation), values of the shape factor SF1 are obtained from the maximum length and the projected area, and the obtained values are averaged.

The toner mother particles used in the exemplary embodiment are not limited in preparation method thereof, and a known method may be used.

External Additive

The external additive of the toner of the exemplary embodiment is not particularly limited, and at least one thereof may be a small-size inorganic oxide having a volume average primary particle size of from approximately 7 to approximately 40 nm that bears the powder fluidity, the charge control and the like. Examples of the small-size inorganic oxide include silica, alumina, an oxide of titanium (such as titanium oxide and metatitanic acid), calcium carbonate, magnesium carbonate, calcium phosphate and carbon black.

Among these, silica particles and titanium oxide particles are preferred.

The external additive may have a surface that has been subjected to a hydrophobic treatment in advance. The hydrophobic treatment may enhance the dispersibility. Examples of the hydrophobic treatment of the surface include treatments with dimethyldimethoxysilane, hexamethyldisilazane (HMDS), methyltrimethoxysilane, isobutyltrimethoxysilane and decyltrimethoxysilane.

In addition to the small-size inorganic oxide, a large-size inorganic oxide having a volume average particle size of from approximately 20 nm to approximately 300 nm may be added. Examples of the large-size inorganic oxide particles include fine particles of silica, titanium oxide, metatitanic acid, aluminum oxide, magnesium oxide, alumina, barium titanate, magnesium titanate, calcium titanate, strontium titanate, zinc oxide, chromium oxide, antimony trioxide, magnesium oxide and zirconium oxide. Among these, particles selected from silica, titanium oxide and metatitanic acid may be preferably used.

The amount of the small-size inorganic oxide added may be from approximately 0.5 part by weight to approximately 2.0 parts by weight per 100 parts by weight of the toner mother particles. In the case where the large-size inorganic oxide is added, the amount of the large-size inorganic oxide may be from approximately 1.0 part by weight to approximately 5.0 parts by weight per 100 parts by weight of the toner mother particles.

Lubricant particles may be used as an external additive.

Examples of the lubricant particles include a solid lubricant, such as graphite, molybdenum disulfide, talc, a fatty acid, a higher alcohol, an aliphatic alcohol and a fatty acid metal salt; a low molecular weight polyolefin, such as polypropylene, polyethylene and polybutene; a silicone compound having a softening point upon heating; a fatty acid amide compound, such as oleic acid amide, erucic acid amide, recinoleic acid amide and stearic acid amide; vegetable wax, such as carnauba wax, rice wax, candelilla wax, wood wax and jojoba oil; animal wax, such as beeswax; mineral or petroleum wax, such as montan wax, ozokerite, ceresin, paraffin wax, microcrystalline wax and Fischer-Tropsch wax; and modified products thereof.

An abrasive may be used as the external additive.

The abrasive may be a known inorganic oxide. Examples thereof include cerium oxide, strontium titanate, magnesium oxide, alumina, silicon carbide, zinc oxide, silica, titanium oxide, boron nitrate, calcium pyrophosphate, zirconia, barium titanate, calcium titanate and calcium carbonate. A composite material thereof may be used.

The toner may be prepared, for example, by mixing the toner mother particles and the external additives with a Henschel mixer, a V-blender or the like. In the case where the toner mother particles are prepared by a wet process, the external additives may be added by a wet process.

The developer of the exemplary embodiment may be used as a developer that is contained in a developing unit (e.g., a developer container) and may also be used as a replenisher developer used in a trickle developing system described later.

Developing Device, Cartridge, Process Cartridge, Image Forming Method, and Image Forming Apparatus A cartridge of the exemplary embodiment will be described.

The cartridge of the exemplary embodiment contains the carrier for developing an electrostatic image of the exemplary embodiment, or contains the developer for an electrostatic image of the exemplary embodiment. The cartridge of the exemplary embodiment may be detachable to an image forming apparatus.

The use of the cartridge of the exemplary embodiment containing the developer of the exemplary embodiment in an image forming apparatus or an image forming method may achieve both reproducibility of thin lines under a high temperature and high humidity environment and suppression of image defect under a low temperature and low humidity environment simultaneously.

The cartridge of the exemplary embodiment may be used in a developing device, an image forming method and an image forming apparatus, which has a trickle developing system.

In the case where the cartridge of the exemplary embodiment is used in a developing device, an image forming method or an image forming apparatus, the cartridge of the exemplary embodiment may contain the developer of the exemplary embodiment, or in alternative, the cartridge of the exemplary embodiment may contain the carrier of the exemplary embodiment solely, which may be used in combination with another cartridge containing a toner solely.

The image forming method of the exemplary embodiment may contain: charging an image holding member; exposing a surface of the image holding member, thereby forming an electrostatic latent image; developing the electrostatic latent image formed on the surface of the image holding member, with a two-component developer, thereby forming a toner image; transferring the toner image formed on the surface of the image holding member, to a surface of a transfer material; and fixing the toner image transferred to the transfer material, in which the two-component developer is the developer for an electrostatic image of the exemplary embodiment.

In the image forming method of the exemplary embodiment, a duplicated image may be formed, for example, in such a manner that a developer is prepared by using the particular carrier, an electrostatic image is formed and developed with the developer by using an ordinary electrophotographic duplicator, and the obtained toner image is transferred to transfer paper and then fixed thereto with a heat roller fixing device having a heating roller set at a prescribed temperature.

The carrier for developing an electrostatic image of the exemplary embodiment may be used in an image forming method of an ordinary electrostatic image developing process (electrophotographic process). The image forming method of the exemplary embodiment may contain, for example, formation of an electrostatic latent image (charging and exposing), development, transferring, and cleaning. These processes themselves are ordinarily practiced in the field of art, and described, for example, in JP-A-56-40868, JP-A-49-91231 and the like. The image forming method of the exemplary embodiment may be practiced by using an ordinarily known image forming apparatus, such as a duplicator, a facsimile machine and the like.

In the charging, an image holding member is charged.

In the exposing, an electrostatic latent image is formed on a surface of the image holding member.

In the development, the electrostatic latent image is developed with a developer layer on a developer holding member, thereby forming a toner image. The developer layer is not particularly limited as far as it contains the developer for an electrostatic image of the exemplary embodiment containing a toner for developing an electrostatic image and the carrier for developing an electrostatic image of the exemplary embodiment.

In the transferring, the toner image is transferred to a transfer material. Examples of the transfer material in the transferring include an intermediate transfer material and a recording medium such as a paper.

In the fixing, the toner image transferred to the transfer paper is fixed, for example, with a heat roller fixing device having a heating roller set at a prescribed temperature, thereby forming a duplicated image.

In the cleaning, the developer for an electrostatic image remaining on the electrostatic latent image holding member is removed.

The image forming method of the exemplary embodiment may contain recycling. In the recycling, the toner for developing an electrostatic image that has been recovered in the cleaning is sent to the developer layer. The image forming method of the exemplary embodiment containing the recycling may be practiced by using an image forming apparatus, such as a duplicator and a facsimile machine, having a toner recycling system. The image forming method of the exemplary embodiment may be applied to a recycling system, in which the toner is recovered simultaneously development, and the cleaning is omitted.

The image forming apparatus of the exemplary embodiment contains: an image holding member; a charging unit that charges the image holding member; an exposing unit that exposes the charged image holding member, thereby forming an electrostatic latent image on the image holding member; a developing unit that develops the electrostatic latent image with a two-component developer, thereby forming a toner image; a transferring unit that transfers the toner image from the image holding member to a transfer material; and a fixing unit that fixes the toner image transferred to the transfer material, in which the two-component developer is the developer for an electrostatic image of the exemplary embodiment.

The image forming apparatus of the exemplary embodiment is not particularly limited as far as it contains the image holding member, the charging unit, the exposing unit, the developing unit and the transferring unit, and may further contain a cleaning unit, an erasing unit and the like.

In the transferring unit, the transferring operation may be performed twice or more by using an intermediate transfer material. Examples of the transfer material in the transferring unit include an intermediate transfer material and paper.

The developing unit may contain: a developer container that contains the developer of the exemplary embodiment; a developer supplying unit that supplies the developer to the developer container; and a developer discharging unit that discharges at least a part of the developer contained in the developer container, i.e., may have a trickle developing system.

The developer to be supplied to the developer container (i.e., a replenisher developer) may have a mixing weight ratio of the toner and the carrier (toner/carrier) of from approximately 2 or more, preferably 3 or more, and more preferably 5 or more.

In the case where a resin coated carrier that is liable to suffer flaking of the coated layer is used the trickle developing system, not only flaking of the coated layer of the developer that is originally contained in the developer container occurs, but also flaking of the coated layer of the developer that is fed from the developer supplying unit to the developer container also occurs. Thus, the influence of resin powder released from the carrier is larger as compared to the case the trickle developing system is not used.

By using the image forming apparatus of the exemplary embodiment using the developer of the exemplary embodiment, however, the coated layer of the developer of the exemplary embodiment is hard to be flaked. Therefore, even when the trickle developing system is employed, the aforementioned problem may not occur. Furthermore, the charge distribution of the toner is stabilized, and both the reproducibility of thin lines under a high temperature and high humidity environment and the suppression of image defect under a low temperature and low humidity environment are achieved simultaneously.

The constitutional components including the image holding member, the units and the like each may have the structure described for the process of the image forming method. The constitutional components each may be a known component. The image forming apparatus of the exemplary embodiment may contain other units, devices and the like in addition to the aforementioned structure. The image forming apparatus of the exemplary embodiment may have a plurality of the constitutional component.

The process cartridge of the exemplary embodiment contains at least a developing unit that develops an electrostatic latent image formed on an image holding member, with the developer for an electrostatic image of the exemplary embodiment, thereby forming a toner image. The process cartridge of the exemplary embodiment may be detachable to an image forming apparatus.

The process cartridge of the exemplary embodiment may further contain other members, such as an erasing unit, depending on necessity.

The use of the process cartridge of the exemplary embodiment containing the developer of the exemplary embodiment in an image forming apparatus may achieve stable image formation for a prolonged period of time with less environmental dependency, such as temperature and humidity, and less flaking of the coated layer.

EXAMPLES

The invention will be described in more detail with reference to examples below, but the invention is not limited to the examples.

Measurement Methods

Volume Average Particle Size of Toner Mother Particles

The volume average particle size of the toner mother particles is measured with Coulter Multisizer II (available from Beckman Coulter, Inc.). The electrolytic solution used is ISOTON-II (available from Beckman Coulter, Inc.).

The measurement is performed in the following manner. From 0.5 mg to 50 mg of a sample is put in 2 mL of a surfactant aqueous solution, which may be a 5% aqueous solution of sodium alkylbenzenesulfonate, and the solution is added to from 100 mL to 150 mL of the electrolytic solution. The electrolytic solution having the sample dispersed therein is subjected to a dispersion treatment for 1 minute with an ultrasonic dispersing device, and the particle size distribution of the particles having a particle size of from 2.0 μm to 60 μm is measured with Coulter Multisizer II using an aperture having an aperture size of 100 μm. The number of particles to be measured is 50,000.

The particle size distribution thus measured is divided into particle size ranges (channels), and an accumulated distribution is drawn for weight or volume from the small size side. The particle size at an accumulation of 50% is designated as a weight average particle size or a volume average particle size.

Shape Factor

The shape factor SF1 is obtained by the following expression.

$$SF1=100\pi\times(ML)^2/(4\times A)$$

wherein ML represents the maximum length of the particles, and A represents the projected area of the particles. The maximum length and the projected area of the particles are measured in such a manner that the particles sampled on slide glass are observed with an optical microscope, and the image is input for image analysis to an image analyzer (Luzex III, available from Nireco Corporation) through a video camera. The number of the sampled carrier particles is 100, and the shape factor SF1 is calculated by using the average value of the sampled particles according to the above expression.

Glass Transition Temperature of Toner Mother Particles

The glass transition temperature (Tg) of the toner mother particles is measured with a differential scanning calorimeter (DSC-50, available from Shimadzu Corporation) at a condition of a temperature increasing rate of 3° C. per minute, in which the temperature at the intersecting point of the base line and the extended line of the rising line in the endothermic region is designated as the glass transition temperature.

Coating Composition 1

| | |
|---|---|
| Copolymer particles of methyl methacrylate and 2,2,6,6-tetramethyl-4-piperidyl acrylate (weight ratio: 80/20, weight average molecular weight: 70,000) | 100 parts by weight |
| Carbon black (VXC72, available from Cabot Speciality Chemicals, Inc.) | 5.0 parts by weight |
| Toluene (available from Wako Pure Chemical Industries, Ltd.) | 500 parts by weight |

The aforementioned components and glass beads (particle size: 1 mm, the same amount as toluene) are put in a sand mill, available from Kansai Paint Co., Ltd., and stirred at a rotation rate of 1,200 rpm for 30 minutes, thereby preparing a coating composition 1 having a solid content of 18%.

Coating Composition 2

A coating composition 2 is prepared in the same manner as in Coating Composition 1 except that copolymer particles of methyl methacrylate and 1,2,2,6,6-pentamethyl-4-piperidyl acrylate (weight ratio: 80/20) is used instead of the copolymer particles of methyl methacrylate and 2,2,6,6-tetramethyl-4-piperidyl acrylate.

Coating Composition 3

A coating composition 3 is prepared in the same manner as in Coating Composition 1 except that copolymer particles of methyl methacrylate and 1,2,5-trimethyl-4-phenyl-4-piperidyl acrylate (weight ratio: 80/20) is used instead of the copolymer particles of methyl methacrylate and 2,2,6,6-tetramethyl-4-piperidyl acrylate.

Coating Composition 4

A coating composition 4 is prepared in the same manner as in Coating Composition 1 except that the carbon black is not used.

Coating Composition 5

A coating composition 5 is prepared in the same manner as in Coating Composition 1 except that the amount of the carbon black is changed to 16 parts by weight.

Coating Composition 6

A coating composition 6 is prepared in the same manner as in Coating Composition 1 except that the weight ratio of the copolymer particles of methyl methacrylate and 2,2,6,6-tetramethyl-4-piperidyl acrylate is changed from 80/20 to 90/10.

Coating Composition 7

A coating composition 7 is prepared in the same manner as in Coating Composition 1 except that the weight ratio of the copolymer particles of methyl methacrylate and 2,2,6,6-tetramethyl-4-piperidyl acrylate is changed from 80/20 to 70/30.

Coating Composition 8

A coating composition 8 is prepared in the same manner as in Coating Composition 1 except that homopolymer particles of methyl methacrylate is used instead of the copolymer particles of methyl methacrylate and 2,2,6,6-tetramethyl-4-piperidyl acrylate.

Coating Composition 9

A coating composition 9 is prepared in the same manner as in Coating Composition 1 except that copolymer particles of methyl methacrylate and dimethyl amino acrylate (weight ratio: 80/20) is used instead of the copolymer particles of methyl methacrylate and 2,2,6,6-tetramethyl-4-piperidyl acrylate.

Coating Composition 10

A coating composition 10 is prepared in the same manner as in Coating Composition 8 except that the carbon black is not used.

Coating Composition 11

A coating composition 11 is prepared in the same manner as in Coating Composition 8 except that the amount of the carbon black is changed to 16 parts by weight.

Carrier 1

| | |
|---|---|
| Mn—Mg ferrite (DFC350, available from Dowa Mining Co., Ltd. volume average particle size: 35 μm, SF1: 135) | 2,000 parts by weight |
| Coating composition 1 | 320 parts by weight |

2,000 parts by weight of Mn—Mg ferrite (DFC35) is put in a vacuum kneader, to which 320 parts by weight of the coating composition 1 is further added. The mixture is depressurized to (1 atm-200 mmHg) at 60° C. under stirring, and mixed for 20 minutes, and the mixture is then heated and depressurized, and dried under stirring at 90° C. and (1 atm-720 mmHg) for 30 minutes, thereby providing coated particles. The coated particles are classified with a 75-μm mesh sieve to provide a carrier 1.

Carrier 2

A carrier 2 is prepared in the same manner as in the carrier 1 except that the coating composition 2 is used instead of the coating composition 1.

Carrier 3

A carrier 3 is prepared in the same manner as in the carrier 1 except that the coating composition 3 is used instead of the coating composition 1.

Carrier 4

A carrier 4 is prepared in the same manner as in the carrier 1 except that the coating composition 4 is used instead of the coating composition 1.

Carrier 5

A carrier 5 is prepared in the same manner as in the carrier 1 except that the coating composition 5 is used instead of the coating composition 1.

Carrier 6

A carrier 6 is prepared in the same manner as in the carrier 1 except that the coating composition 6 is used instead of the coating composition 1.

Carrier 7

A carrier 7 is prepared in the same manner as in the carrier 1 except that the coating composition 7 is used instead of the coating composition 1.

Carrier 8

A carrier 8 is prepared in the same manner as in the carrier 1 except that the coating composition 8 is used instead of the coating composition 1.

Carrier 9

A carrier 9 is prepared in the same manner as in the carrier 1 except that the coating composition 9 is used instead of the coating composition 1.

Carrier 10

A carrier 10 is prepared in the same manner as in the carrier 1 except that the coating composition 10 is used instead of the coating composition 1.

Carrier 11

A carrier 11 is prepared in the same manner as in the carrier 1 except that the coating composition 11 is used instead of the coating composition 1.

Colorant Dispersion 1

| | |
|---|---|
| Cyan pigment (copper phthalocyanine, C.I. Pigment Blue 15:3, available from Dainichiseika Colour & Chemicals Mfg. Co., Ltd. | 50 parts by weight |
| Anionic surfactant (Neogen SC, available from Dai-ichi Kogyo Seiyaku Co., Ltd.) | 5 parts by weight |
| Ion exchanged water | 200 parts by weight |

The aforementioned components are mixed and dispersed with Ultra-Turrax, available from IKA Works, Inc., for 5 minutes and then with an ultrasonic bath for 10 minutes, thereby providing a colorant dispersion 1 having a solid content of 21%.

Releasing Agent Dispersion 1

| | |
|---|---|
| Paraffin wax (HNP-9, available from Nippon Seiro Co., Ltd.) | 19 parts by weight |
| Anionic surfactant (Neogen SC, available from Dai-ichi Kogyo Seiyaku Co., Ltd.) | 1 part by weight |
| Ion exchanged water | 80 parts by weight |

The aforementioned components are mixed in a heat resistant vessel, and the mixture is heated to 90° C. and stirred for 30 minutes. The molten liquid is taken out from the bottom of the vessel and sent to Gaulin Homogenizer. After performing the circulation operation corresponding to three passes under a pressure of 5 MPa, the pressure is increased to 35 MPa, and the circulation operation corresponding to three passes is performed. The obtained emulsion liquid is cooled to 40° C. or lower in the heat resistant vessel, thereby providing a releasing agent dispersion 1.

Resin Particle Dispersion

Oily Layer

| | |
|---|---|
| Styrene (available from Wako Pure Chemical Industries, Ltd.) | 30 parts by weight |

-continued

| | |
|---|---|
| n-Butyl acrylate (available from Wako Pure Chemical Industries, Ltd.) | 10 parts by weight |
| β-Carboxyethyl acrylate (available from Rhodia Nicca, Ltd.) | 1.3 parts by weight |
| Dodecanethiol (available from Wako Pure Chemical Industries, Ltd.) | 0.4 part by weight |

Aqueous Layer 1

| | |
|---|---|
| Ion exchanged water | 17 parts by weight |
| Anionic surfactant (Dowfax, available from Dow Chemical Company) | 0.4 part by weight |

Aqueous Layer 2

| | |
|---|---|
| Ion exchanged water | 40 parts by weight |
| Anionic surfactant (Dowfax, available from Dow Chemical Company) | 0.05 part by weight |
| Ammonium peroxodisulfate (available from Wako Pure Chemical Industries, Ltd.) | 0.4 part by weight |

The components of the oily layer and the components of the aqueous layer 1 are mixed by stirring in a flask to prepare a monomer emulsion liquid. The component of the aqueous layer are put in a reactor, the interior of which is then sufficiently substituted with nitrogen gas, and the reaction system is heated to 75° C. over an oil bath under stirring. The monomer emulsion liquid is added slowly dropwise to the reactor over 3 hours to perform emulsion polymerization. After completing the dropwise addition, the polymerization is continued at 75° C. and terminated after lapsing 3 hours.

The resin particles has a volume average particle size $D_{50v}$ of 250 nm as measured with a laser diffraction particle size distribution measuring device (LA-700, available from Horiba, Ltd.) and a glass transition temperature of 52° C. as measured with a differential scanning calorimeter (DSC-50, available from Shimadzu Corporation) at a temperature increasing rate of 10° C. per minute. Thus, a resin particle dispersion having a volume average particle size of 250 nm, a solid content of 42% and a glass transition temperature of 52° C. is obtained.

Toner 1

| | |
|---|---|
| Resin particle dispersion | 150 parts by weight |
| Colorant dispersion 1 | 30 parts by weight |
| Releasing agent dispersion 1 | 40 parts by weight |
| Polyaluminum chloride | 0.4 part by weight |

The aforementioned components are sufficiently mixed and dispersed with Ultra-Turrax, available from IKA Works, Inc., in a stainless steel flask, and then heated to 48° C. understirring over a heating oil bath. After maintaining at 48° C. for 80 minutes, 70 parts by weight of the same resin particle dispersion as above is slowly added thereto.

Thereafter, the pH inside the system is controlled to 6.0 with a sodium hydroxide aqueous solution having a concentration of 0.5 mol/L, and the reaction mixture is heated to 97° C. and maintained for 3 hours under continuously stirring with the stainless steel flask being sealed and the stirrer shaft being sealed with a magnetic seal. After completing the reaction, the reaction mixture is cooled at a temperature decreasing rate of 1° C. per minute and then filtered. The solid content is sufficiently rinsed with ion exchanged water, and then collected by solid-liquid separation by Nutsche suction filtration. The solid content is again dispersed in 3,000 parts by weight of ion exchanged water at 40° C. and stirred and rinsed at 300 rpm for 15 minutes. The rinsing operation is repeated five times, and when the pH of the filtrate becomes 6.54 and the electroconductivity thereof becomes 6.5 μS/cm, the solid content is collected by solid-liquid separation by Nutsche suction filtration with No. 5A filter paper. The solid content is continuously dried under vacuum for 12 hours to provide toner mother particles.

The toner mother particles has a volume average particle size $D_{50v}$ of 6.2 μm and a volume average particle size distribution index GSDv of 1.20, as measured with Coulter Counter TA-II (available from Beckman Coulter, Inc.). The shape of the mother particles is observed with Luzex image analyzer (available from Nireco Corporation), and as a result, the particles have a shape factor SF1 of 135, which shows a potato-like shape. The glass transition temperature of the toner mother particles is 52° C. To the toner mother particles, silica ($SiO_2$) fine particles having an average primary particle size of 40 nm having been subjected to a surface hydrophobic treatment with hexamethyldisilazane (which may be hereinafter abbreviated as HMDS) and metatitainic acid compound fine particles having an average primary particle size of 20 nm, which are a reaction product of metatitanic acid and isobutyltrimethoxysilane, are added to make a coverage of 40% with respect to the surface of the colored particles, followed by mixing with a Henschel mixer, thereby providing a toner.

Preparation of Amorphous Resin Particle Dispersion

| | |
|---|---|
| Ethylene glycol (available from Wako Pure Chemical Industries, Ltd.) | 50 parts by weight |
| Neopentyl glycol (available from Wako Pure Chemical Industries, Ltd.) | 65 parts by weight |
| Terephthalic acid (available from Wako Pure Chemical Industries, Ltd.) | 96 parts by weight |

The aforementioned monomers are charged in a flask, and the mixture is heated to a temperature of 190° C. over one hour. After confirming that the reaction system is stirred homogeneously, 1.2 parts by weight of dibutyltin oxide is added thereto. The reaction mixture is heated from that temperature to 240° C. over 6 hours, and the dehydration condensation reaction is continued at 240° C. for 4 hours, while distilling water produced, thereby providing a polyester resin having an acid value of 10.0 mgKOH/g, a weight average molecular weight of 12,000 and a glass transition temperature of 60° C.

The polyester resin maintained in a molten state is supplied to an emulsification dispersing device (Cavitron CD1010, available from Eurotec, Ltd.) at a rate of 100 g/min. Diluted aqueous ammonia having a concentration of 0.37% by weight, which is obtained by diluting an aqueous ammonia with ion exchanged water, is put in an aqueous medium tank, and is supplied to Cavitron at a rate of 100 g/min simultaneously with the molten polyester resin. Cavitron is operated at a rotation rate of the rotor of 60 Hz and a pressure of 5 $kg/m^2$, thereby providing an amorphous resin particle dispersion having an average particle size of 160 nm, a solid content of 30%, a glass transition temperature of 60° C. and a weight average molecular weight Mw of 12,000.

Preparation of Binder Resin 1

Octanedioic acid 87 parts by weight
(available from Wako Pure Chemical Industries, Ltd.)
Decanediol 87 parts by weight
(available from Wako Pure Chemical Industries, Ltd.)

The aforementioned monomers are charged in a flask, and the mixture is heated to a temperature of 160° C. over one hour. After confirming that the reaction system is stirred homogeneously, 0.02 part by weight of dibutyltin oxide is added thereto. The reaction mixture is heated from that temperature to 200° C. over 6 hours, and the dehydration condensation reaction is continued at 200° C. for 4 hours, while distilling water produced, thereby completing the reaction. The reaction mixture is cooled and then subjected to solid-liquid separation, and the obtained solid content is dried in vacuum at 40° C., thereby providing a binder resin 1.

The obtained binder resin 1 has a melting point of 70° C. as measured with a differential scanning calorimeter (DSC-7, available from Perkin-Elmer, Inc., and a weight average molecular weight of 15,000 as measured with a molecular weight measuring device, HLC-8020, available from Tosoh Corporation, with tetrahydrofuran (THF) as a solvent.

Preparation of Crystalline Resin Particle Dispersion

| | |
|---|---|
| Binder resin 1 | 50 parts by weight |
| Anionic surfactant (Neogen SC, available from Dai-ichi Kogyo Seiyaku Co., Ltd.) | 2 parts by weight |
| Ion exchanged water | 200 parts by weight |

The aforementioned components are heated to 120° C., sufficiently dispersed with Ultra-Turrax, available from IKA Works, Inc., and then dispersed with a pressure discharge homogenizer, and the solid content is recovered when the volume average particle size becomes 180 nm. Thus, a crystalline resin particle dispersion having a solid content of 20% is obtained.

Toner 2

| | |
|---|---|
| Amorphous resin particle dispersion | 150 parts by weight |
| Colorant particle dispersion | 30 parts by weight |
| Releasing agent particle dispersion 1 | 40 parts by weight |
| Crystalline resin particle dispersion | 50 parts by weight |
| Polyaluminum chloride | 0.4 part by weight |

The aforementioned components are sufficiently mixed and dispersed with Ultra-Turrax, available from IKA Works, Inc., in a stainless steel flask, and then heated to 48° C. under stirring over a heating oil bath. After maintaining at 48° C. for 60 minutes, 70 parts by weight of the same resin particle dispersion as above is slowly added thereto.

Thereafter, the pH inside the system is controlled to 8.0 with a sodium hydroxide aqueous solution having a concentration of 0.5 mol/L, and the reaction mixture is heated to 90° C. and maintained for 3 hours under continuously stirring with the stainless steel flask being sealed and the stirrer shaft being sealed with a magnetic seal. After completing the reaction, the reaction mixture is cooled at a temperature decreasing rate of 2° C. per minute and then filtered. The solid content is sufficiently rinsed with ion exchanged water, and then collected by solid-liquid separation by Nutsche suction filtration. The solid content is again dispersed in 3,000 parts by weight of ion exchanged water at 40° C. and stirred and rinsed at 300 rpm for 15 minutes. The rinsing operation is repeated five times, and when the pH of the filtrate becomes 6.5 and the electroconductivity thereof becomes 6.5 μS/cm, the solid content is collected by solid-liquid separation by Nutsche suction filtration with No. 5A filter paper. The solid content is continuously dried under vacuum for 12 hours to provide toner mother particles.

The toner mother particles has a volume average particle size $D_{50v}$ of 6.3 μm and a volume average particle size distribution index GSDv of 1.20, as measured with Coulter Counter TA-II (available from Beckman Coulter, Inc.). The shape of the mother particles is observed with Luzex image analyzer (available from Nireco Corporation), and as a result, the particles have a shape factor SF1 of 135, which shows a potato-like shape. The glass transition temperature of the toner mother particles is 52° C. To the toner mother particles, silica ($SiO_2$) fine particles having an average primary particle size of 40 nm having been subjected to a surface hydrophobic treatment with hexamethylsilazane and metatitainic acid compound fine particles having an average primary particle size of 20 nm, which are a reaction product of metatitanic acid and isobutyltrimethoxysilane, are added to make a coverage of 40% with respect to the surface of the colored particles, followed by mixing with a Henschel mixer, thereby providing a toner.

Example 1

The toner 1 and the carrier 1 are mixed to make a ratio of the toner of 8% by weight, thereby providing a developer 1.

Examples 2 to 9 and Comparative Example 1 to 6

Developers 2 to 9 and C1 to C6 are prepared in the same manner as in Example 1 except that the toners and the carriers shown in Table 1 are used.

Evaluation of Reproducibility of Thin Lines

The reproducibility of thin lines is evaluated in an environment at a temperature of 28° C. and a humidity of 85% RH in an evaluation room. The paper used for evaluation is A4 paper (P Paper, available from Fuji Xerox Co., Ltd.). The image forming apparatus used for evaluation is a modified machine of ApeosPort-II 400 (available from Fuji Xerox Co., Ltd.) having a trickle developing system, in which the circumferential velocity of the developing sleeve of the developing device is changed to 500 mm/sec.

5,000 sheets of images with an image density of 20% are formed, and then 5,000 sheets of images with an image density of 5% are formed. The image formation is repeated, and 150,000 sheets at most of images are formed. In the image formation, a halftone image containing thin lines drawn at an angle of 45' with respect to the process direction of the developer is formed every 10,000 sheets (including before starting the image formation), and disturbance of the thin lines (the thickness and density of the lines) is confirmed. The evaluation is terminated at the number of sheets when disturbance occurs. Even though disturbance does not occur at 150,000 sheets, the evaluation is not continued any more. The tolerance of the evaluation of reproducibility of thin lines is 100,000 sheets of more.

Evaluation of Image Defect

The image defect is evaluated in an environment at a temperature of 10° C. and a humidity of 15% RH in an evaluation room. The paper and the apparatus for evaluation are the same as in the evaluation of reproducibility of thin lines. After forming 10,000 sheets of images with an image density of 5%, an image shown in FIG. 1 is output, and the length t (mm) of deletion (white dropout) is measured with a loupe equipped with a scale. The tolerance of the evaluation of image defect is a length of deletion of less than 0.5 mm.

The results of the evaluations are shown in Table 1. In Example 9 and Comparative Example 6, the development is performed without trickle development.

TABLE 1

| | Toner | Carrier | Trickle development | Evaluation of reproducibility of thin lines (number of sheets when disturbance of thin lines occurs) | Evaluation of image defect (length of deletion (mm)) |
|---|---|---|---|---|---|
| Example 1 | toner 1 | carrier 1 | yes | 130,00 | 0.3 |
| Example 2 | toner 1 | carrier 2 | yes | >150,000 | 0.2 |
| Example 3 | toner 1 | carrier 3 | yes | 130,000 | 0.3 |
| Example 4 | toner 1 | carrier 4 | yes | 130,000 | 0.4 |
| Example 5 | toner 1 | carrier 5 | yes | 110,000 | 0.2 |
| Example 6 | toner 1 | carrier 6 | yes | 120,000 | 0.4 |
| Example 7 | toner 1 | carrier 7 | yes | >150,000 | 0.3 |
| Example 8 | toner 2 | carrier 1 | yes | 140,000 | 0.3 |
| Example 9 | toner 1 | carrier 1 | no | 110,000 | 0.3 |
| Comparative Example 1 | toner 1 | carrier 8 | yes | 70,000 | 0.6 |
| Comparative Example 2 | toner 1 | carrier 9 | yes | 80,000 | 0.7 |
| Comparative Example 3 | toner 1 | carrier 10 | yes | 100,000 | 1.0 |
| Comparative Example 4 | toner 1 | carrier 11 | yes | 30,000 | 0.4 |
| Comparative Example 5 | toner 2 | carrier 8 | yes | 60,000 | 0.6 |
| Comparative Example 6 | toner 1 | carrier 8 | no | 50,000 | 0.6 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A carrier for developing an electrostatic image, comprising:

magnetic core material particles; and a coated layer coated on the magnetic core material particles, the coated layer containing a resin having a monomer unit represented by following formula (A'):

(A')

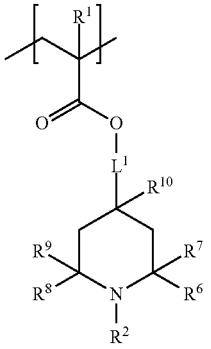

wherein:

$R^1$ represents a hydrogen atom or a methyl group;

$R^2$ represents a hydrogen atom, an alkyl group, an aryl group or an aralkyl group;

$R^6$ represents an alkyl group;

$R^7$ to $R^9$ each independently represent a hydrogen atom or an alkyl group;

$R^{10}$ represents an alkyl group, an aryl group, or an aralkyl group;

$L^1$ represents a single bond or an alkylene group; and content of the monomer unit represented by the formula (A') is 10% by mol or more.

2. The carrier for developing an electrostatic image according to claim 1, wherein the coated layer contains carbon black.

3. The carrier for developing an electrostatic image according to claim 2, wherein a content of the carbon black in the coated layer is approximately 15.0% by mass or less based on the resin having a monomer unit represented by the formula (A').

4. The carrier for developing an electrostatic image according to claim 1, wherein in the formula (A'), $R^2$ represents a hydrogen atom or an alkyl group having from 1 to 4 carbon atoms.

5. A developer for an electrostatic image, comprising:

the carrier for developing an electrostatic image according to claim 1, and a toner.

6. The developer for an electrostatic image according to claim 5, wherein the toner contains a crystalline resin.

7. An image forming method comprising:

charging an image holding member;

exposing a surface of the image holding member, thereby forming an electrostatic latent image;

developing the electrostatic latent image formed on the surface of the image holding member, with a two-component developer, thereby forming a toner image;

transferring the toner image formed on the surface of the image holding member, to a surface of a transfer material; and fixing the toner image transferred to the transfer material, wherein the two-component developer is the developer for an electrostatic image according to claim 5.

8. The carrier for developing an electrostatic image according to claim 1, wherein content of the monomer unit represented by the formula (A') is 20% by mol or more.

9. The carrier for developing an electrostatic image according to claim 8, wherein content of the monomer unit represented by the formula (A') is 30% by mol or more.

* * * * *